United States Patent [19]

Yamada

[11] Patent Number: 4,768,564

[45] Date of Patent: Sep. 6, 1988

[54] WIRELESS LET-OFF AND TAKE-UP CONTROL SYSTEM

[75] Inventor: Shigeo Yamada, Komatsu, Japan

[73] Assignee: Tsudakoma Corp., Kanazawa, Japan

[21] Appl. No.: 104,754

[22] Filed: Oct. 2, 1987

[30] Foreign Application Priority Data

Oct. 3, 1986 [JP] Japan ..... 61-153022[U]

[51] Int. Cl.[4] ..... D03D 49/00

[52] U.S. Cl. ..... 139/97; 139/1 R; 139/99; 139/304; 242/36; 242/57; 28/201

[58] Field of Search ..... 28/201; 139/97, 99, 139/110, 304, 307, 308, 309, 1 R, 371; 66/232; 242/36, 57; 57/264

[56] References Cited

U.S. PATENT DOCUMENTS 4,234,021 11/1980 Clokie ..... 139/371
4,292,800 10/1981 Werst ..... 57/264
4,605,044 8/1986 Sakano ..... 139/99
4,628,967 12/1986 Osterle et al. ..... 139/304
4,712,588 12/1987 Sainen ..... 139/97

*Primary Examiner*—Henry S. Jaudon
*Attorney, Agent, or Firm*—Flynn, Thiel, Boutell & Tanis

[57] ABSTRACT

A wireless let-off and take-up control system for controlling the let-off motion and take-up mechanism of a loom or looms by wireless. The control system comprises a portable transmitter or transmitters, and a receiver or receivers each associated with the controller of a loom for controlling the let-off motion and take-up mechanism of the loom. Instructions for controlling the let-off motion and the take-up mechanism are given by wireless by operating the transmitter through the receiver to the controller of the loom at an optional position around the loom, so that a single operator is able to observe the movement of warps and, if necessary, to vibrate the warps in order to enable the warps to move smoothly past the droppers, the mails of heddles and reed of the loom in preparing a new warp beam for weaving operation on the loom.

5 Claims, 3 Drawing Sheets

WIRELESS LET-OFF AND TAKE-UP CONTROL SYSTEM

BACKGROUND OF THE INVENTION

1. Field of the Invention

The present invention relates to controlling the electrically driven let-off motion and electrically driven take-up motion of a loom and, more specifically, to a wireless let-off and take-up control system capable of controlling motors respectively for the let-off motion and the take-up motion in changing an old warp beam for a new warp beam to move knots formed by tying together the respective warps of the old and new warp beams.

2. Description of the Prior Art

There are several methods of changing an old warp beam for a new warp beam. In changing an old warp beam for a new warp beam without changing the heddles and the reed, first the warp yarns of the old beam are cut near the old beam before changing the old warp beam for the new warp beam. Then, it is necessary to tie the warp yarns of the old warp beam and those of the new warp beam, respectively, by a tying machine, and to draw the warp yarns of the new warp beam so as to move knots formed in tying together the respective warp yearns of the new and old warp beam through the mails of heddles and the reed toward the front. Then, the warp yarns of the new warp beam are wound around the cloth beam to start the loom for weaving operation.

Incidentally, the warp yarns must be drawn in carefully so that the knots are not caught by the reed, droppers and the mails of the heddles. Ordinarily, in drawing in the warp yarns, one operator operates the control panel of the loom to operate the take-up mechanism and let-off motion of the loom properly so that the warp yarns are moved without being excessively relaxed or tightened, while another operator watches the movement of the warp yarns and flaps the warp yarns so that the knots will pass the reed, the droppers and the mails of the heddles. Therefore, changing the warp beam requires at least two operators and the unsuccessful cooperation of the two operators causes the breakage of the warp yarns, which is not desirable from the viewpoint of work efficiency and labor saving.

SUMMARY OF THE INVENTION

Accordingly, it is a principal object of the present invention to enable a single operator to control the let-off motion and take-up mechanism of the loom and to vibrate the warp yarns at an optional position around the loom.

According to the present invention, a controller for controlling a let-off motor for driving the let-off motion and a take-up motor for driving the take-up mechanism is provided with a receiver, and command signals are given through the receiver to the controller by a transmitter by wireless to control the operation of the motors.

Thus, the present invention enables a single operator to control the operation of the motors and to vibrate the warp yarn at an optional position around the loom, so that the warp beam changing operation can be carried out by a single operator.

Since the present invention enables the control of the let-off motor and the take-up motor by a portable transmitter and a receiver associated with the controller of the loom at an optional position around the loom, a job, such as a job for passing the knots in the warp yarns through the dents of the reed and the droppers and the mails of the heddles, conventionally requiring at least two operators can easily be carried out by a single operator, so that work efficiency is improved and labor is saved in changing the warp beam. Furthermore, the wireless let-off and take-up control system of the present invention can easily be incorporated into the conventional loom.

Furthermore, the wireless let-off and take-up control system may comprise a portable transmitter and a portable receiver which can be coupled with any one of the controllers of a plurality of looms. Such a constitution requires only a single receiver for individually controlling a plurality of looms for warp beam changing operation, so that the wireless let-off an take-up control system can be applied to a weaving mill at a low cost and only an objective loom is controlled surely for warp beam changing operation without causing accidental warp changing operation of the adjacent looms.

The above and other objects, features and advantages of the present invention will become apparent from the following description taken in conjunction with the accompanying drawings.

DETAILED DESCRIPTION OF THE PREFERRED EMBODIMENTS

Figure 1:
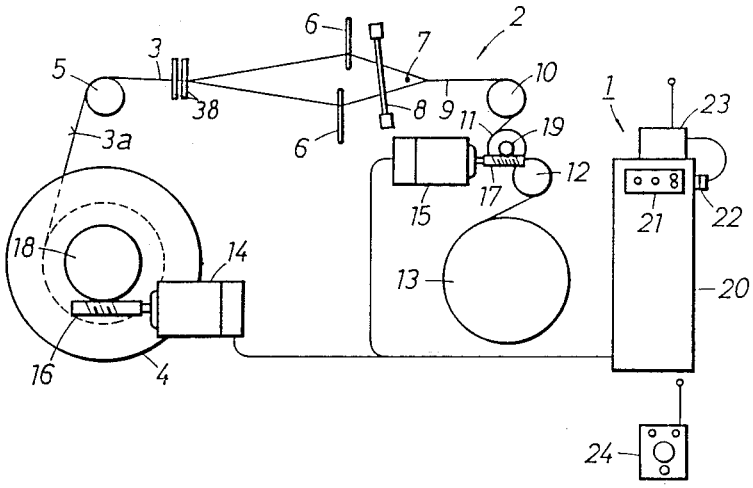
FIG. 1 is a diagrammatic illustration showing a wireless let-off and take-up control system, in a preferred embodiment, according to the present invention in combination with a loom.

Shown in FIG. 1 are a wireless let-off and take-up control system 1 according to the present invention, and a loom 2. A plurality of warp yarns 3 are extended between a warp beam 4 and a cloth fell via a guide roller 5, droppers 38 and heddles 6. The warp yarns 3 are controlled for shedding motion by the heddles 6, weft yarns 7 are inserted into the sheds of the warp yarns, and the inserted weft yarns 7 are beaten by a reed 8 to form a woven cloth 9. The woven cloth 9 is moved along a breast beam 10 by a surface roller 11 and is taken up through a guide roller 12 by a take-up roller 13 in a cloth beam. The warp beam 4 and the surface roller 11 are driven for rotation by an individual let-off motor 14 and an individual take-up motor 15 through a worm 16 and worm wheel 18 and through a worm 17 and worm wheel 19, respectively. The motors 14 and 15 are controlled by the controller 20 of the loom 2. The controller 20 is provided with a control panel 21 for controlling the let-off motor 14 for rotation in the normal direction or in the reverse direction and for controlling the take-up motor 15 for continuous rotation and inching.

The wireless let-off an take-up control system 1 comprise a receiver 23 which can be connected to the controller 20 by a connector 22, and a portable transmitter 24 capable of communicating with the receiver by wireless. The receiver 23 and the transmitter 24 are applied to controlling a plurality of looms 2.

Figure 2:
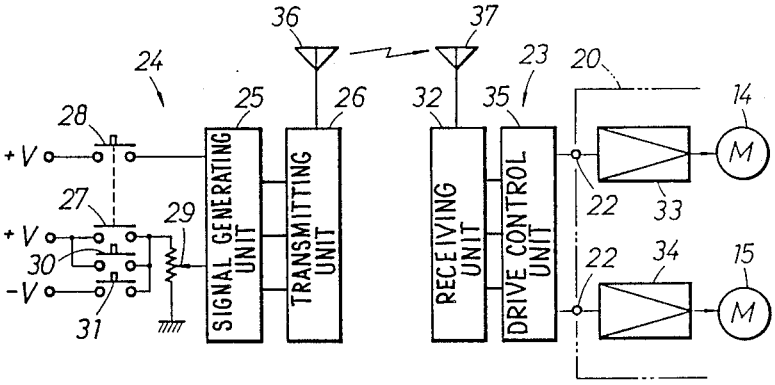
FIG. 2 is a block diagram of the transmitter and receiver of the wireless let-off and take-up control system of FIG. 1.

Referring to FIG. 2, the transmitter 24 comprises a signal generating unit 25, a transmitting unit 26, and a transmitting antenna 36. A speed regulator 29 connected to a let-off switch 27, and a take-up switch 28 interlocked with the let-off switch 27 are connected to the input of the signal generating unit 25. A let-off-only switch 30 and a reverse let-off switch 31 are connected in parallel to the let-off switch 27.

The receiver 23 comprises a receiving unit 32, a drive control unit 35 connected to the receiving unit 32 and capable of being connected by the connector 22 to motor driving units 33 and 34 respectively for driving the motors 14 and 15, and a receiving antenna 37. The transmitting unit 26 of the transmitter 24 transmits signals by wireless through the transmitting antenna 36 and the receiving unit 32 of the receiver 23 receives the signal through the receiving antenna 37.

As mentioned above, in replacing an old warp beam with a new warp beam 4, the warp yarns 3 of the new warp beam 4 and the warp yarns 3 of the old warp beam are tied, respectively, after mounting the new warp beam 4 on the loom 2, and then the let-off motor 14 and the take-up motor 15 are actuated to unwind the warp yarns 3 of the new warp beam 4 from the new warp beam 4 in order to move knots 3*a* in the warp yarns 3 through droppers 38, the heddles 6 and the dents of the reed 8 and pass the cloth fell.

In moving the knots 3*a* toward the front, first, the receiver 23 is connected by the connector 22 to the controller 20 of the objective loom 2, the warp yarns are tightened moderately, and then the let-off switch 27 and the take-up switch 28 of the portable transmitter 24 are turned on simultaneously to actuate both the motors 14 and 15 for rotaton in the normal direction. While the knots 3*a* are being moved toward the front, movement of the knots 3*a* is watched. When the warp yarns are caught or almost caught by obstacles, the warp yarns are stopped instantly to adjust the position thereof and, if necessary, the warps 3 are flapped or vibrated so as to advance the knots 3*a* without being caught by the droppers 38, the hedlles 6 and the dents of the reed 8. Such a warp yarn flapping or vibrating work can be performed at an optional position around the loom 2 carrying the transmitter 24, so that the control of the let-off motion and the take-up mechanism, and the work for vibrating the warp yarns 3 can be carried out by a single operator. The rotating speed of the let-off motor 14 is regulated by the speed regulator 29. Only the let-off motor 14 can individually be rotated in the normal direction or in the reverse direction by operating the switch 30 or 31.

The signal generating unit 25 of the transmitter 24 generates a coded signal corresponding to the contents of an instruction, the transmitting unit 26 modulates and amplifies the coded signal, and then the modulated and amplified coded signal is transmitted through the transmitting antenna 36. On the other hand, the receiver 23 receives the coded signal sent by wireless through the receiving antenna 37, detects and amplifies the coded signal by the receiving unit 32, and then the drive control unit 35 controls the motor driving units 33 and 34 according to the contents of the instruction. The respective rotating speeds of the motors 14 and 15 are regulated according to an analog value regulated by the speed regulator 29.

Basically, the wireless let-off and take-up control system 1 comprises a single receiver 23 and a signal transmitter 24 as mentioned above. However, the present invention may be practiced in the following embodiments.

Figure 3:
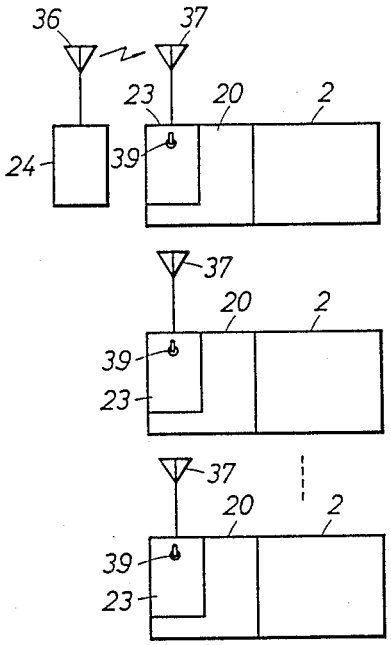
FIGS. 3 to 6 are block diagrams showing further embodiments of the present invention.

Referring to FIG. 3, a wireless let-off and take-up control system, in a second embodiment, according to the present invention comprises a single transmitter 24, and a plurality of receivers 23 respectively incorporated into the controllers 20 of a plurality of looms 2. Each receiver 23 is provided with a main switch 39, which is turned on to bring the receiver 23 operative only when the warp beam changing operation is executed for the associated loom 2. Accordingly, all the receivers 23 can be controlled by signals of a single transmitting frequency without any trouble.

Figure 4:
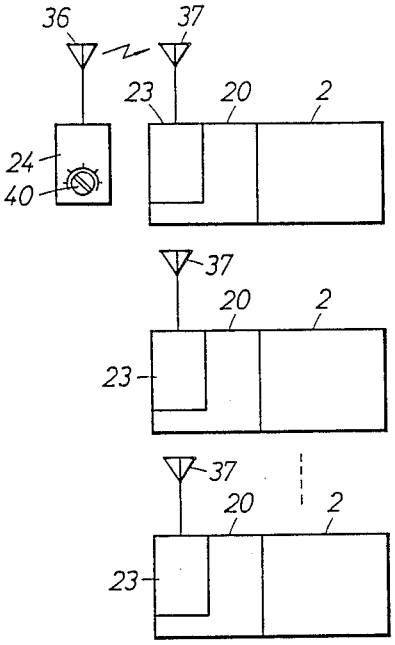

Referring to FIG. 4, a wireless let-off and take-up control system, in a third embodiment, according to the present invention comprises a single transmitter 24, and a plurality of receivers 23 respectively of different receiving frequencies. The transmitter 24 is provided with an internal transmitting frequency regulating function and a frequency selecting knob 40. The transmitting frequency of the transmitter 24 is decided selectively to communicate with only one of the receivers 23 at a time.

Figure 5:
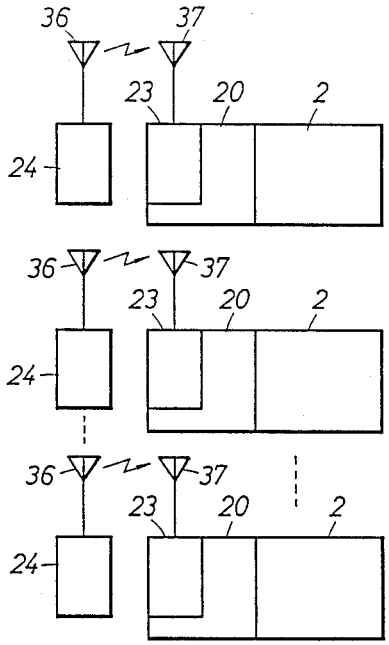

Referring to FIG. 5, a wireless let-off and take-up control system, in a fourth embodiment, according to the present invention comprises a plurality of sets each of a receiver 23 and a transmitter 24 respectively for a plurality of looms 2. Each transmitter 24 transmits control signals of a specific frequency to the associated receiver 23.

Figure 6:
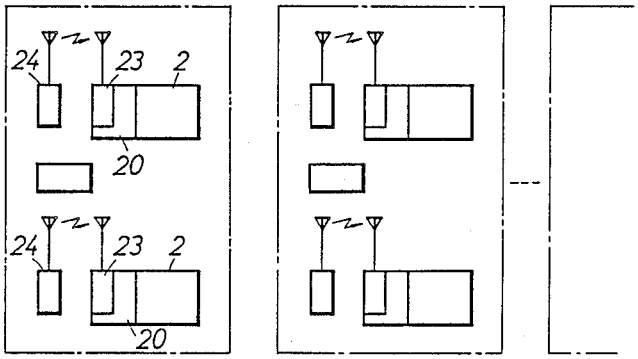

Referring to FIG. 6, a wireless let-off and take-up control system, in a fifth embodiment, according to the present invention is intended for application to a weaving mill installed with a large number of looms 2. In the fifth embodiment, the same wireless let-off and take-up control system as that shown in any one of FIGS. 2 to 5 is applied to each of groups each of a plurality of looms 2.

Although only the let-off switch 27 of the transmitter 24 is combined with the speed regulator 29, the let-off switch 30 for actuating only the let-off motor 14, and the reverse let-off switch 31 for reversing the let-off motor 14 in the foregoing embodiment, the take-up switch 28, similarly to the let-off switch 27, may be combined with a speed regulator, a switch for actuating the take-up motor 15 for individual operation, and a switch for reversing the take-up motor 15.

Furthermore, although the present invention has been described as applied to a loom or looms each having motors 14 and 15 respectively for exclusively driving the let-off motion and the take-up mechanism in addition to the main motor of the loom, the present invention is applicable also to a loom or looms each having a mechanical transmission system interlocked through clutches with the let-off motion and the take-up mechanism.

Furthermore, means for carrying signals from the transmitter to the receiver need not be limited to radio waves, but the means may be rays of light or ultrasonic waves.

What is claimed is:

1. A wireless let-off and take-up control system for controlling the let-off motion and take-up mechanism of a loom having a let-off motor for rotating a warp beam, a take-up motor for rotating the take-up roller thereof, and a controller for controlling the let-off motor and the take-up motor, which comprises:

a portable wireless transmitter which transmits signals corresponding to instructions given thereto by operating a let-off switch for giving instructions specifying modes of operation of the let-off motor, and by operating a take-up switch for giving instructions specifying modes of operation of the take-up motor; and a receiver which is associated with the controller of the loom, receives signals from said wireless transmitter, and gives signals corresponding to the instructions to the controller of the loom.

2. A wireless let-off and take-up control system according to claim 1, wherein said receiver is connected to the controller of the loom by a connector.

3. A wireless let-off and take-up control system for controlling the respective let-off motions and respective take-up mechanisms of a plurality of looms each having a let-off motor for rotating a warp beam, a take-up motor for rotating the take-up roller thereof, and a controller for controlling the let-off motor and the take-up motor, which comprises:

a portable wireless transmitter which transmits signals corresponding to instructions given thereto by operating a let-off switch for giving instructions specifying modes of operation of the let-off motor, and by operating a take-up switch for giving instructions specifying modes of operation of the take-up motor; and a plurality of receivers each of which is associated with the controller of a respective said loom, receives signals from said wireless transmitter, and give signals corresponding to the instructions to the controller of the loom.

4. A wireless let-off and take-up control system according to claim 3, wherein said wireless transmitter is capable of selectively transmitting signals of different transmitting frequencies, and each of said receivers has an intrinsic receiving frequency.

5. A wireless let-off and take-up control system for controlling the respective let-off motions and respective take-up mechanisms of a plurality of groups each of a plurlaity of looms each having a let-off motor for rotating a warp beam, a take-up motor for rotating the take-up roller thereof, and a controller for controlling the let-off motor and the take-up motor, which comprises:

a plurality of portable wireless transmitters each of which transmits signals corresponding to instructions given thereto by operating a let-off switch for giving instructions specifying modes of operation of the let-off motor, and instructions given thereto by operating a take-up switch for giving instructions specifying modes of operation of the take-up motor; and a plurality of receivers each of which is associated with the controller of the loom, receives signals from said wireless transmitter and gives signals corresponding to the instructions to the controller of the associated loom, devided into a plurality of groups each corresponding to each group of looms and to each wireless transmitter.

* * * * *